US005163374A

United States Patent [19]

Rehmat et al.

[11] Patent Number: 5,163,374

[45] Date of Patent: Nov. 17, 1992

[54] COMBUSTION PROCESS

[75] Inventors: Amirali G. Rehmat, Westmont; Mark J. Khinkis, Morton Grove, both of Ill.

[73] Assignee: Institute of Gas Technology, Chicago, Ill.

[21] Appl. No.: 750,197

[22] Filed: Aug. 27, 1991

[51] Int. Cl.[5] ..... F23B 7/00

[52] U.S. Cl. ..... 110/342; 110/347; 110/234; 110/245

[58] Field of Search ..... 110/245, 342, 347, 234, 110/345

[56] References Cited

U.S. PATENT DOCUMENTS 4,651,653 3/1987 Anderson et al. .
4,704,084 11/1987 Liu et al. .
4,824,360 4/1989 Janka et al. .
4,824,441 4/1989 Kindig .
4,843,981 7/1989 Goldbach et al. .
4,848,251 7/1989 Breen et al. .
4,854,249 8/1989 Khinkis et al. .
4,872,423 10/1989 Pillai .
4,913,068 4/1990 Brannstrom .
4,936,047 6/1990 Feldmann et al. .
4,947,803 8/1990 Zenz ..... 110/245
4,960,057 10/1990 Ohshita et al. .
4,981,667 1/1991 Berg et al. .
5,012,750 5/1991 Sheely et al. ..... 110/245

*Primary Examiner*—Henry C. Yuen
*Attorney, Agent, or Firm*—Speckman & Pauley

[57] ABSTRACT

A process for combustion of hydrocarbonaceous materials containing high levels of sulfur, fuel-bound nitrogen and low levels of ash which inhibits the emissions of oxides of nitrogen and sulfur, reduces solid waste disposal, and produces useable by-products. In the first step of the process, the hydrocarbonaceous material is burned in a fluidized bed into which a calcium based sorbent is introduced, producing a mixture of gaseous products of combustion and particulate matter, ash and calcium containing solids. In a second step of the process, the mixture of gaseous products of combustion and particulate matter is completely burned in a cyclonic combustion reactor. In a third step of the process, the ash and calcium-containing solids generated in the fluidized bed are withdrawn from the fluidized bed, cooled and contacted with steam in a regenerator producing calcium hydroxide, ash and unspent sorbent which are recycled to the fluidized bed.

14 Claims, 1 Drawing Sheet

COMBUSTION PROCESS

BACKGROUND OF THE INVENTION

1. Field of the Invention

This invention relates to a process for combustion of hydrocarbonaceous fuels containing high levels of sulfur, fuel-bound nitrogen, and low levels of ash which inhibits the emissions of solid wastes, oxides of nitrogen and sulfur.

2. Description of the Prior Art

In conventional processes for the combustion of hydrocarbonaceous fuels containing high levels of sulfur, fuel-bound nitrogen, and low levels of ash utilizing sorbent injection, the production of solid waste streams containing calcium sulfate, unspent sorbent and ash is disproportionately large. For example, the combustion of petroleum coke, which contains approximately 1.5% fuel-bound nitrogen, 4% sulfur and 0.2% ash using a known combustion process with sorbent injection for sulfur removal, consumes about 250 lbs. of calcium-based sorbent for every 1,000 lbs. of coke combusted and produces a solid waste stream in excess of 240 lbs., more than half of which is in the form of calcium sulfate, a very stable product which is difficult to regenerate and reuse. In addition, in this known single stage combustion process, a significant portion of the fuel-bound nitrogen is converted into oxides of nitrogen which are environmentally unacceptable.

Several processes for the combustion of sulfur-and nitrogen-containing carbonaceous materials are disclosed by the prior art. U.S. Pat. No. 4,854,249 discloses a process for combustion of sulfur- and nitrogen-containing carbonaceous fuels in a two stage combustion process in which sulfur- and nitrogen-containing carbonaceous materials and a sulfur fixation agent are introduced into a first combustion stage of a fluidized bed having a density/size selective solids withdrawal conduit at the base of the fluidized bed. Gaseous sulfur compounds are reacted with oxides of the sulfur fixation agent in a reducing region of the fluidized bed to form an intermediate solid metallic sulfur compound which, in turn, is reacted in an oxidizing region at the base of the fluidized bed to form a sulfur-containing compound which is withdrawn through the density/size selective solids withdrawal conduit together with agglomerated ash. Nitrogen contained in the carbonaceous materials is converted to molecular nitrogen in the reducing region of the fluidized bed. Ash produced in the bed is agglomerated and withdrawn through the density/size selective solids withdrawal conduit.

U.S. Pat. No. 4,848,251 teaches a process for combustion of carbonaceous materials containing ash and sulfur in slagging combustors, including control of slag within a temperature range of 2000° F.-2500° F., slag stoichiometry less than oxiding, and gas phase stoichiometry near stoichiometric. Other known methods for reducing sulfur emissions in combustion processes are disclosed by U.S. Pat. No. 4,651,653 which teaches a sorbent injection system in which a sorbent, such as limestone, is introduced into a furnace in which a sulfur-bearing fuel is burned at gas temperatures of approximately 2400° F.; U.S. Pat. No. 4,824,360 in which fuel and oxidizer are combusted in a combustion reactor at temperatures between 900° C.-1500° C., the combustion gases formed being directed into a suspension reactor into which a sulfur fixation compound is fed; U.S. Pat. No. 4,824,441 in which a composition of refined coal having low ash forming material and inorganic sulfur content, a sulfur sorbent, a sulfation promoter, and a catalyst for the reaction of sulfur dioxide to sulfur trioxide is burned in an oxygen restricted burner; U.S. Pat. No. 4,872,423 in which the effectiveness of sulfur absorbent when burning sulfur-containing coal in a fluidized bed of particulate material is improved by removing the bed material containing sulfur absorbent from the fluidized bed and mixing it with steam; U.S. Pat. No. 4,913,068 in which the effectiveness of a sulfur absorbent containing calcium in a power plant burning fuel in a fluidized bed of particulate matter is improved by crushing the absorbent and dividing it into fine and coarse fractions, supplying the course fraction directly to the fluidized bed, and calcinating the fine fraction which, acting as a drying agent for the fuel, is introduced into the bed together with the fuel; U.S. Pat. No. 4,936,047 in which a mixture of sulfur-containing particulate fuel and sulfur absorbent is injected into a reducing atmosphere in a combustor at a temperature of at least 1500° F., forming a gaseous portion and a solid portion, the solid portion being further combusted, forming an ash containing sulfur fixed therein; and U.S. Pat. No. 4,981,667 in which the sulfur content of flue gases from the combustion of petroleum pitch, containing about 40% petroleum coke dissolved therein, and petroleum pitch, containing about 25% sawdust dissolved therein, is converted into a solid by adding lime to the fuel before burning it.

Fines recirculation in a fluidized bed combustor is disclosed in U.S. Pat. No. 4,843,981 in which a bed containing inert particles, ash and some partially burned solid fuel particles on a distribution plate within an internal combustion chamber of a fluidized bed combustor are fluidized by a fluidizing gas flowing upward within the combustion chamber from below the distribution plate and having a velocity such that fine particles are carried upward within the combustion chamber, captured in a particulate recycle separator and, subsequently, returned to the fluidizing bed. Fluidizing gas passing through the fines separator continues through a convective heat exchanger in which heat is removed from the gas and, downstream of the convective heat exchanger, through a filter system to remove dust before being exhausted to the atmosphere U.S. Pat. No. 4,704,084 discloses a method of lowering nitrogen oxides and minimizing sulfur dioxide in the reaction gases from the combustion of fuel in a multi-solid fluidized bed. The lower region of the fluidized bed is operated under substoichiometric conditions. The upper region of the fluidized bed is operated under oxiding conditions. A size difference is maintained between large and small particles in the bed such that substantially all of the larger particles are at least four times the size of the smaller particles. A portion of the fine particles is recycled to the lower region of the bed and another portion of the fine particles is recycled to the upper region of the bed.

U.S. Pat. No. 4,960,057 discloses a method of waste incineration using a fluidized bed type incinerator in which a granular material comprising titanium oxide or aluminum oxide is employed as a fluidizing medium to prevent the generation of harmful substances such as dioxin.

In all the known processes for the combustion of carbonaceous fuels containing fuel-bound nitrogen, sulfur and low levels of ash, the solid waste produced from such processes cannot be recycled. Rather, elaborate discharge mechanisms and processes to stabilize the waste are required.

SUMMARY OF THE INVENTION

It is an object of this invention to provide a process for the combustion of hydrocarbonaceous fuels containing high levels of sulfur, fuel-bound nitrogen, and low levels of ash in which solid waste generated in the process can be recycled.

It is another object of this invention to provide a process for the combustion of hydrocarbonaceous fuels containing high levels of sulfur, fuel-bound nitrogen, and low levels of ash which does not require ash to agglomerate or calcium sulfide to be converted to calcium sulfate.

It is yet another object of this invention to provide a process for the combustion of hydrocarbonaceous fuels containing high levels of sulfur, fuel-bound nitrogen, and low levels of ash using a simple ash discharge mechanism without reducing the efficiency of the combustion process.

It is yet another object of this invention to provide a process for the combustion of hydrocarbonaceous fuels containing high levels of sulfur fuel-bound nitrogen, and low levels of ash which inhibits the emissions of oxides of nitrogen and sulfur.

It is yet another object of this invention to provide a process for the combustion of hydrocarbonaceous fuels containing high levels of sulfur, fuel-bound nitrogen, and low levels of ash in which spent sorbent is recycled to reduce solid waste disposal while producing a useable byproduct.

These objects are achieved in accordance with this invention in an integrated three step process in which, in the first step, hydrocarbonaceous fuels containing high levels of sulfur (1%–8%), fuel-bound nitrogen, and low levels of ash (0.1%–3.0%) and at least a first portion of calcium-based sorbent are introduced into a fluidized bed of a fluidized bed reactor. Fluidization is provided by introducing a gaseous oxidant into the fluidized bed, such that a reducing condition is maintained in the fluidized bed, producing a mixture of gaseous products consisting primarily of products of incomplete combustion, and particulate matter, ash, and calcium-containing solids. Preferred oxidants are air, oxygen enriched air, and industrial grade oxygen. Temperature in the fluidized bed is maintained at about 1500° F. to about 2300° F., preferably at about 1700° F. to about 1900° F.

Under the reducing condition in the fluidized bed, the fuel-bound nitrogen is converted mostly to elemental nitrogen. Very little of the fuel-bound nitrogen is converted to ammonia and hydrogen cyanide. Sulfur in the fluidized bed is converted to hydrogen sulfide and/or carbonyl sulfide. In accordance with one embodiment of this invention, carbonyl sulfide is further converted to calcium sulfide in a reaction with calcium oxide. The ash and calcium-containing solids, primarily calcium sulfide, are discharged from the fluidized bed through either an overflow pipe or an underflow pipe located at the distributor upon which the fluidized bed is situated.

In accordance with one embodiment of this invention, a cyclone is situated within the fluidized bed stage to collect a significant portion of the particulate matter mixed with the gaseous products of combustion. The collected particulate matter is returned to the fluidized bed. The relatively clean gaseous products of combustion, containing a residual amount of particulate matter comprising solids and sorbents, are burned in the second step of this process, a cyclonic combustion reactor. Oxidant, preferably combustion air, in an amount sufficient to provide about 5%–15% excess oxygen, is introduced into the cyclonic combustion reactor to complete the combustion of the gaseous products of combustion containing primarily incomplete products of combustion from the fluidized bed reactor. In accordance with one embodiment of this invention, oxidant is introduced into the cyclonic combustion reactor in stages to minimize the formation of oxides of nitrogen.

In accordance with another embodiment of this invention, at least a portion of calcium-based sorbent is introduced into the cyclonic combustion reactor to remove sulfur remaining in the gaseous products of combustion from the fluidized bed reactor. The solids produced in the cyclonic combustion reactor, namely, calcium sulfate, unspent sorbent and ash, are disposed of separately.

In the third step of the process of this invention, the mixture of ash, calcium sulfide and unspent sorbent discharged from the fluidized bed reactor is cooled to a temperature of about 700° F.–1000° F. The cooled mixture is then contacted with steam to produce hydrogen sulfide and active calcium hydroxide. The sulfur from the resulting gas stream of steam and hydrogen sulfide is recovered by employing a known commercial process, such as the Clauss Process. The mixture of calcium hydroxide, unspent sorbent and ash is recycled back into the fluidized bed region of the fluidized bed reactor. Only a small make-up quantity of fresh sorbent is added to the fluidized bed.

These and other objects and features of this invention will be more readily understood and appreciated from the description and drawings contained herein.

DESCRIPTION OF PREFERRED EMBODIMENTS

Figure 1:
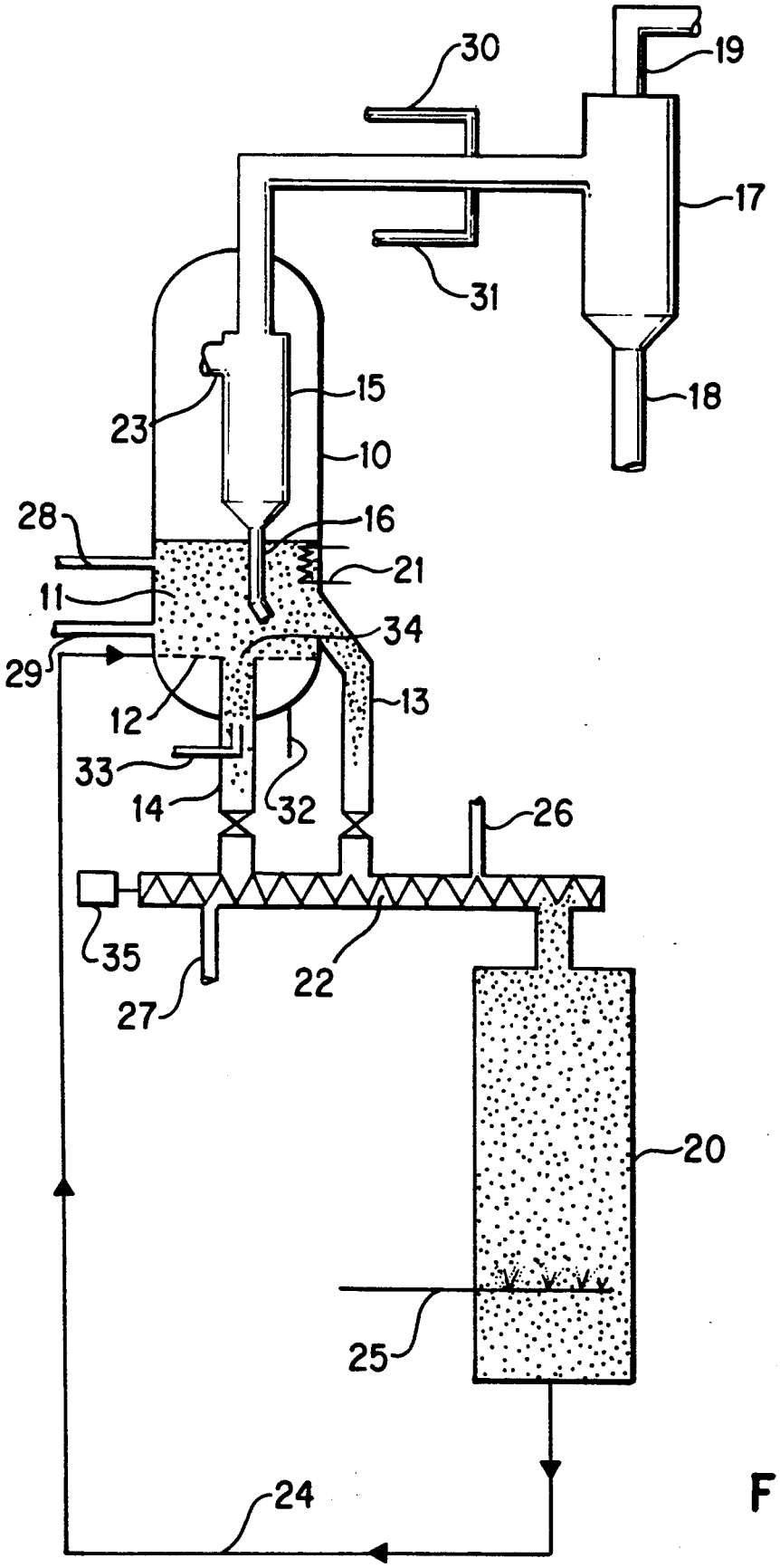
FIG. 1 shows a schematic diagram of the process in accordance with one embodiment of this invention.

In the process in accordance with one embodiment of this invention, hydrocarbonaceous materials containing high levels of sulfur, fuel-bound nitrogen and low levels of ash ar introduced into fluidized bed 11 within fluidized bed reactor 10 together with a first portion of calcium-based sorbent, preferably, limestone or dolomite, through carbonaceous fuel/sorbent inlet line 28 and/or make-up sorbent line 29. For purposes of this disclosure, hydrocarbonaceous materials having low levels of ash is defined to mean hydrocarbonaceous materials having about 0.1% to about 3.0% ash content. In addition, the amount of sulfur in the hydrocarbonaceous materials is about 1.0% to about 8.0%. Oxidant for combustion of the hydrocarbonaceous materials in fluidized bed 11 and for effecting fluidization of the fluidized bed is introduced by way of oxidant inlet 32 through distribution grate 12 into fluidized bed 11. Preferred oxidants are air, oxygen enriched air, and industrial grade oxygen. The amount of oxygen introduced into fluidized bed 11 is less than the stoichiometric requirement for complete combustion of the hydrocarbonaceous materials in fluidized bed 11, thereby maintaining reducing conditions within fluidized bed 11 of fluidized bed reactor 10. The stoichiometric ratio of oxidant to hydrocarbonaceous materials is preferably about 0.3 to about 0.8. As a result, the fuel-bound nitrogen is converted primarily to elemental nitrogen and very little is converted to ammonia and hydrogen cyanide. In addition, sulfur is converted to hydrogen sulfide and/or carbonyl sulfide.

Also under the reducing conditions prevailing in fluidized bed 11, calcium-based sorbent is converted to calcium oxide. Calcium oxide subsequently reacts with hydrogen sulfide and/or carbonyl sulfide to produce calcium sulfide and either water or carbon dioxide, according to the following reactions:

$$CaO + H_2S \rightarrow CaS + H_2O$$

$$CaO + COS \rightarrow CaS + CO_2$$

Up to 95% of the sulfur present in the incoming hydrocarbonaceous materials is captured in this manner.

Due to the reducing conditions prevailing in fluidized bed 11, the gaseous products of combustion produced by combustion of the hydrocarbonaceous materials include carbon monoxide, carbon dioxide, hydrogen, methane, water, and traces of ammonia, hydrogen sulfide, carbonyl sulfide and hydrogen cyanide. Mixed with the gaseous products of combustion is particulate matter comprising char, reacted and unreacted sorbent and ash.

Temperature in fluidized bed 11 is maintained in the range of about 1500° F. to about 2300° F. In a preferred embodiment of this invention, temperature in fluidized bed 11 is maintained in the range of about 1700° F. to about 1900° F. Pressure in fluidized bed reactor 10, in accordance with one embodiment of this invention, is about 1 atm to about 30 atm depending upon the end application. The velocity of oxidant in fluidized bed 11 is about 1 ft/s to about 15 ft/s depending upon the size distribution of the hydrocarbonaceous materials and the sorbent. Constant temperature in fluidized bed 11 is maintained by removal of heat through heat exchanger 21, for example, heating in-bed water tubes to raise steam. Other known means for heat removal can also be used to maintain a constant temperature in fluidized bed 11.

In a preferred embodiment of this invention, the quantity of calcium-based sorbent introduced into fluidized bed 11 is such that the molar ratio of calcium to sulfur present in the hydrocarbonaceous materials is about 1.5 to about 4.0.

The combustion of hydrocarbonaceous materials in fluidized bed 11 produces a mixture of solids containing primarily calcium sulfide, unspent sorbent and ash. This mixture is discharged from fluidized bed 11 either through overflow discharge pipe 13 disposed above distribution grate 12 or underflow discharge pipe 14 in communication with an opening 34 in distribution grate 12. To control the discharge of the mixture of solids through underflow discharge pipe 14, an upflowing inert gas, such as nitrogen or recirculated flue gas, is introduced through inert gas inlet line 33 into underflow discharge pipe 14. The velocity of the inert gas depends on the size and quantity of solids discharged. To increase the amount of solids discharged, the velocity of the upflowing inert gas is reduced; to decrease the quantity of solids discharged, the velocity of the upflowing inert gas is increased.

The mixture of gaseous products of combustion and particulate matter from fluidized bed 11 is introduced into cyclone 15 through cyclone inlet 23. A significant portion of the particulate matter in the mixture is separated from the gaseous products of combustion and returned to fluidized bed 11 through cyclone discharge 16. The relatively clean gaseous products of combustion, containing products of incomplete combustion and some residual particulate matter, are introduced into the second stage of the process of this invention, cyclonic combustion reactor 17, in which the relatively clean gaseous products of combustion are completely combusted with oxidant injected through oxidant inlet line 30. About 5% to about 15% excess oxygen is maintained to complete the combustion. Temperature in cyclonic combustion reactor 17 is about 1900° F. to about 2100° F. In accordance with one embodiment of this invention, the oxidant is introduced into cyclonic combustion reactor 1 in stages to minimize the formation of oxides of nitrogen.

In a preferred embodiment of this invention, a second portion of calcium-based sorbent is introduced into the gaseous products of combustion through sorbent inlet line 31 resulting in removal of the remaining sulfur from the exhaust gases exiting cyclonic combustion reactor 17 through cyclonic combustion reactor exhaust gas discharge 19. Also produced in cyclonic combustion reactor 17 are solids comprising calcium sulfate, unspent sorbent, and ash which are discharged from cyclonic combustion reactor 17 through cyclonic combustion solids discharge 18 and disposed of separately.

In step three of the process in accordance with this invention, the mixture of calcium sulfide, unspent sorbent and ash from fluidized bed 11, discharged from either overflow discharge pipe 13 or underflow discharge pipe 14, is cooled by indirect means to about 700° F. to about 1000° F. In accordance with a preferred embodiment of this invention, the indirect means for cooling said mixture is cooling screw 22 driven by cooling screw motor 35 into which water is introduced through cooling screw water inlet line 26 and from which water is withdrawn through cooling screw water outlet line 27. The cooled mixture is introduced into regenerator 20 in which it is contacted with steam introduced through regenerator steam inlet line 25 into regenerator 20. Upon contact of the cooled mixture with steam, hydrogen sulfide and active calcium hydroxide are produced in accordance with the following reaction:

$$CaS + 2H_2O \rightarrow Ca(OH)_2 + H_2S$$

The amount of steam required by this reaction varies, depending upon the contacting method employed, anywhere from about 1 to about 2 times the stoichiometric ratio. The sulfur from the resulting gas stream of steam and hydrogen sulfide is recovered using known commercial processes, for example, the Clauss Process.

The mixture of dry calcium hydroxide, unspent sorbent and ash is recycled back into fluidized bed 11 through regenerator discharge line 24. To provide for continuous operation of the process, only a small make up quantity of fresh calcium-based sorbent needs to be added.

Calcium hydroxide returned to fluidized bed 1 reacts with sulfur compounds in fluidized bed 11 in the same manner as the incoming sorbent in accordance with the following reactions:

$$Ca(OH)_2 \rightarrow CaO + H_2O$$

$$CaO + H_2S \rightarrow CaS + H_2O$$

$$CaO + COS \rightarrow CaS + CO_2$$

Only a small amount of calcium sulfide, unspent sorbent and ash is discarded continuously from the system to avoid the build up of these materials in the system. If the ash is subsequently separated from the calcium sulfide and unspent sorbent, the separated calcium sulfide and unspent sorbent can be introduced into regenerator 20 for converting calcium sulfide to calcium hydroxide for reuse in the process to further minimize the make up requirement of fresh sorbent.

While in the foregoing specification, this invention has been described in relation to certain preferred embodiments thereof, and many details have been set forth for purpose of illustration, it will be apparent to those skilled in the art that the invention is susceptible to additional embodiments and that certain of the details described therein can be varied considerably without departing from the basic principles of the invention.

We claim:

1. A process for combustion of hydrocarbonaceous materials containing high levels of sulfur, fuel-bound nitrogen and low levels of ash comprising:

introducing said hydrocarbonaceous materials and a first portion of calcium-based sorbent into a fluidized bed of a reactor;

introducing an oxidant into said fluidized bed producing a mixture of gaseous products of combustion and a particulate matter, and said ash and calcium-containing solids;

maintaining a reducing condition in said fluidized bed;

maintaining a fluidized bed temperature of about 1500° F. to about 2300° F. in said fluidized bed;

discharging said ash and said calcium-containing solids from said reactor;

separating said particulate matter from said mixture producing clean products of combustion containing an amount of residual particulate matter and recycling said particulate matter to said fluidized bed;

introducing a second portion of calcium-based sorbent and said clean products of combustion containing said residual particulate matter into a cyclonic combustion reactor;

burning and removing sulfur from said clean products of combustion containing said residual particulate matter in said cyclonic combustion reactor producing exhaust gases, additional ash and additional calcium-containing solids;

disposing of said additional ash and said additional calcium-containing solids;

cooling said ash and said calcium-containing solids to a discharge temperature of about 700° F. to about 1000° F.;

mixing said ash and said calcium-containing solids with steam producing hydrogen sulfide and calcium hydroxide;

recovering sulfur from said hydrogen sulfide; and recycling said calcium hydroxide, said ash and unspent sorbent to said fluidized bed.

2. A process in accordance with claim 1, wherein a pressure is maintained in said reactor from about 1 atmosphere to about 30 atmospheres.

3. A process in accordance with claim 1, wherein said fluidized bed temperature is about 1700° F. to about 1900° F.

4. A process in accordance with claim 1, wherein a velocity of said oxidant is about 1 ft/sec to about 15 ft/sec.

5. A process in accordance with claim 1 further comprising maintaining a mole ratio of calcium introduced into said fluidized bed to sulfur in said hydrocarbonaceous materials of about 1.5 to about 4.0.

6. A process in accordance with claim 1, wherein said ash and said calcium-containing solids are discharged from said fluidized bed through one of an overflow pipe and an underflow pipe.

7. A process in accordance with claim 1, wherein cyclonic combustor oxidant is introduced into said cyclonic combustion reactor in an amount sufficient to provide an effective excess oxygen level of about 5% to about 15%.

8. A process in accordance with claim 7, wherein said cyclonic combustor oxidant is introduced into said cyclonic combustion reactor in stages.

9. A process in accordance with claim 1, wherein said products of combustion containing said residual particulate matter are burned in said cyclonic combustion reactor at a cyclonic combustion reactor temperature of about 1900° F. to about 2400° F.

10. A process in accordance with claim 1, wherein a second portion of said calcium-based sorbent is mixed with said products of combustion containing said residual particulate matter prior to burning said products of combustion containing said residual particulate matter in said cyclonic combustion reactor.

11. A process in accordance with claim 1, wherein an amount of steam mixed with said particulate matter is about 1.0 to about 2.0 of a stoichiometric requirement for complete reaction of said steam with said particulate matter.

12. A process in accordance with claim 1, wherein said particulate matter comprises particulate calcium sulfide, particulate unspent sorbent and particulate ash.

13. A process in accordance with claim 1, wherein said ash comprises about 0.1% to about 3.0% of said hydrocarbonaceous material.

14. A process in accordance with claim 1, wherein said sulfur comprises about 1.0% to about 8.0% of said hydrocarbonaceous material.

* * * * *